US009422832B2

(12) United States Patent
Riemann

(10) Patent No.: US 9,422,832 B2
(45) Date of Patent: Aug. 23, 2016

(54) METHOD FOR CONTROLLING A COOLING PROCESS OF TURBINE COMPONENTS

(71) Applicant: Siemens Aktiengesellschaft, Munich (DE)

(72) Inventor: Stefan Riemann, Kaarst (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 90 days.

(21) Appl. No.: 14/372,014

(22) PCT Filed: Nov. 7, 2012

(86) PCT No.: PCT/EP2012/071982
§ 371 (c)(1),
(2) Date: Jul. 12, 2014

(87) PCT Pub. No.: WO2013/110365
PCT Pub. Date: Aug. 1, 2013

(65) Prior Publication Data

US 2015/0047353 A1 Feb. 19, 2015

(30) Foreign Application Priority Data

Jan. 25, 2012 (EP) ..... 12152446

(51) Int. Cl.
*F01K 7/34* (2006.01)
*F04D 31/00* (2006.01)
(Continued)

(52) U.S. Cl.
CPC ..... *F01K 13/025* (2013.01); *F01D 25/12* (2013.01); *F01K 13/02* (2013.01); *F05B 2220/301* (2013.01); *F05B 2260/212* (2013.01); *F05D 2220/31* (2013.01); *F05D 2260/212* (2013.01)

(58) Field of Classification Search
CPC ..... F01K 13/025; F01K 13/02; F01D 25/12; F05D 2260/212; F05D 2220/31; F05B 2220/301; F05B 2260/212
USPC ..... 60/653, 677, 678, 679, 646, 657; 415/116
See application file for complete search history.

(56) References Cited

U.S. PATENT DOCUMENTS 3,173,654 A * 3/1965 Roe ..... F01D 25/10 290/40 R
5,388,960 A 2/1995 Ayano
(Continued)

FOREIGN PATENT DOCUMENTS

BY 8094 C1 6/2006
CN 1136131 A 11/1996
(Continued)

*Primary Examiner* — Hoang Nguyen
(74) *Attorney, Agent, or Firm* — Beusse Wolter Sanks & Maire

(57) ABSTRACT

A method for controlling a cooling process of turbine components of a steam turbine shaft, wherein an air flow mixed with a water mist is used to cool the turbine components during a mist cooling phase (P4) is provided. The mist cooling phase (P4) is preceded by an air cooling phase (P3), during which an air flow is used to cool the turbine components. A constant temporal temperature gradient is specified for the cooling process, wherein the air flow density is adjusted by the valve position of a controllable regulating valve and a switch is made from the air cooling phase (P3) to the mist cooling phase (P4) if the maximum air flow density is reached and in particular if the regulating valve is fully open.

9 Claims, 2 Drawing Sheets

(51) Int. Cl.
*F01K 13/02* (2006.01)
*F01D 25/12* (2006.01)

(56) References Cited

U.S. PATENT DOCUMENTS

| | | | | |
|---|---|---|---|---|
| 5,953,900 | A * | 9/1999 | Bannister | F01D 25/12 60/39.17 |
| 6,094,914 | A | 8/2000 | Zorner | |
| 6,145,317 | A | 11/2000 | Gobrecht et al. | |
| 6,272,861 | B1 | 8/2001 | Bergmann | |
| 6,443,690 | B1 | 9/2002 | Zabrecky | |
| 6,898,935 | B2 | 5/2005 | Trygstad | |
| 8,356,974 | B2 * | 1/2013 | Inomata | F01D 11/02 415/1 |
| 2007/0251210 | A1 | 11/2007 | Ceric et al. | |
| 2011/0085886 | A1 * | 4/2011 | Kasibhotla | F01D 11/001 415/1 |
| 2011/0214430 | A1 | 9/2011 | Pauli et al. | |

FOREIGN PATENT DOCUMENTS

| | | | |
|---|---|---|---|
| CN | 1194025 | A | 9/1998 |
| CN | 1231715 | A | 10/1999 |
| CN | 1306600 | A | 8/2001 |
| DE | 2307887 | A1 | 8/1974 |
| EP | 1050666 | A2 | 11/2000 |
| EP | 1500792 | A2 | 1/2005 |
| EP | 1630356 | A1 | 3/2006 |
| EP | 2365197 | A1 | 9/2011 |
| JP | H03294605 | A | 12/1991 |
| JP | H0559904 | A | 3/1993 |
| JP | H6159008 | A | 6/1994 |
| JP | H06159008 | A | 6/1994 |
| JP | H08218811 | A | 8/1996 |
| JP | H09177505 | A | 7/1997 |
| JP | H11270306 | A | 10/1999 |
| JP | 2001500943 | A | 1/2001 |
| JP | 2011208634 | A | 10/2011 |
| RU | 2379524 | C1 | 1/2010 |
| SU | 580336 | A1 | 11/1977 |
| SU | 769035 | A1 | 10/1980 |
| SU | 931916 | A1 | 5/1982 |
| SU | 941636 | A1 | 7/1982 |
| WO | 9419584 | A1 | 9/1994 |
| WO | 9961758 | A2 | 12/1999 |

* cited by examiner

METHOD FOR CONTROLLING A COOLING PROCESS OF TURBINE COMPONENTS

CROSS REFERENCE TO RELATED APPLICATIONS

This application is the U.S. National Stage of International Application No. PCT/EP2012/071982 filed Nov. 7, 2012, and claims the benefit thereof. The International Application claims the benefit of European Application No. EP12152446 filed Jan. 25, 2012. All of the applications are incorporated by reference herein in their entirety.

FIELD OF INVENTION

The invention relates to a method for controlling a cooling process of turbine components, in particular of a steam turbine shaft.

BACKGROUND OF INVENTION

Maintenance work is very time-consuming in the case of turbines and in particular steam turbines, since the turbine components of the turbine or of the steam turbine first of all have to be cooled down before the turbine can be stopped and before the maintenance work can be carried out.

Corresponding cooling of the turbine components is in this case usually accelerated with the aid of an air stream in order to reduce the time required for the maintenance work to as short as possible. In order to generate the air stream, use is made of ambient air, the temperature of which limits the cooling action of the air stream in the case of such forced cooling.

SUMMARY OF INVENTION

Against this background, the invention is based on an object of specifying an improved method for the forced cooling of turbine components.

This object is achieved according to the invention by a method having the features of the claims.

The method serves to control a cooling process of turbine components, in particular of a steam turbine shaft, wherein, during a mist cooling phase, an air stream with added water mist is used to cool the turbine components. In contrast to steam, which is used as working medium during operation of the steam turbine, the water mist is an aerosol, that is to say a mixture of air and water droplets, which can pick up and transport away thermal energy to a particularly high degree as a result of a phase change of the contained water from the liquid to the gaseous phase. The air stream with the added water mist is therefore not the working medium. It is fed as a further medium through the turbine for cooling purposes. In this way, simple cooling by forced convection, that is to say for example air cooling, is supplemented by additional evaporative cooling, with the result that the effectiveness of the cooling is significantly increased by way of relatively simple means. Such supplementation is advantageous in particular when a cooling system for simple air cooling already exists, since in this case retrofitting can take place without great technical outlay, it merely being necessary to install an apparatus with the aid of which a water mist is generated and introduced into the air cooling air stream. As a result of the combination of simple air cooling with evaporative cooling, the cooling process can be controlled over an increased temperature range compared with simple air cooling, such that a desired temperature gradient over time is specified.

According to a method variant, the cooling process is designed in a multistage manner, wherein the mist cooling phase is preceded by an air cooling phase during which only an air stream without water mist is used to cool the turbine components. Accordingly, depending on the requirements, the cooling of the turbine components is forced either with the aid of the air stream or with the aid of the air stream with the added water mist. In this way, very different quantities of heat can be coupled out of the turbine and transported away per unit time by different operating modes of a cooling system.

According to a method variant, during the air cooling phase and during the mist cooling phase, a uniform and constant temperature gradient over time is specified for the cooling process. In this case, in particular a temperature gradient over time of about 5-15 K/h, in particular of about 10 K/h, is preferred. For operation of a turbine that is as economical as possible, it is expedient to keep the time requirement for necessary maintenance work as short as possible. Accordingly, it is desirable to cool down the turbine components as quickly as possible for corresponding maintenance. However, forced cooling that is too intensive entails the risk of stresses building up for example in the turbine components, it being possible for these stresses to result in damage to the turbine components. Therefore, when designing the turbine components as part of the planning of the turbine, a maximum temperature gradient over time is defined. Consequently, the cooling process according to the method set out here is preferably controlled such that the specified maximum temperature gradient is achieved as precisely as possible and is maintained throughout the cooling process. The abovementioned value for the temperature gradient of about 10 K/h represents a typical value for steam turbines here. As a rule, such a maximum temperature gradient over time is specified for a limited temperature range, for which reason, in the case of a cooling process over a very wide temperature range, it is quite possible for a plurality of different values to be specified. In this case, the cooling process is controlled such that, in each corresponding temperature range, the temperature gradient specified therefor is achieved and is maintained throughout the temperature range.

According to a very expedient variant of the method, in order to specify the temperature gradient, only the stream density of the air stream is regulated during the air cooling phase and only the quantity of water mist added to the air stream is regulated during the mist cooling phase. As a result, a suitable cooling system for the turbine and in particular a control system for the cooling system can be realized technically in a particularly simple manner. In addition, a corresponding control is relatively unsusceptible to faults, since only one variable is ever changed as part of the control.

Furthermore, it is expedient to set the stream density of the air stream via the valve position of a controllable inlet valve. In the case of steam turbines for example a negative pressure is frequently generated in the steam turbine via a corresponding evacuation device, wherein a pressure gradient between the turbine inlet and the turbine outlet is specified. Thus, by way of an inlet valve positioned at the turbine inlet, during constant operation of the evacuation device, an air stream by way of which the turbine components of the steam turbine can be cooled can be generated with the aid of the ambient air. Via the valve position, the stream density of the air stream, that is to say the quantity of air per unit time, can then be regulated.

In addition, it is advantageous to switch from the air cooling phase into the mist cooling phase when the maximum air stream density has been reached and in particular when the inlet valve is fully open. In the case of the above-described cooling system for the steam turbine, in which the evacuation device and the inlet valve in the inlet region of the steam turbine are used in order to generate an air stream for cooling the turbine components, the effectiveness of the cooling depends on the temperature difference between the temperature of the turbine components and the temperature of the ambient air used for the air stream. At the start of the cooling process, this temperature difference is entirely sufficient for achieving the specified maximum temperature gradient and maintaining it over a certain temperature range. However, as the temperature of the turbine components drops, the effectiveness of the simple air cooling drops and, in order to maintain the temperature gradient, the inlet valve has to be opened more and more, with the result that the stream density of the air stream rises. If the cooling process has advanced further, at some point the time will have been reached at which the valve is fully open and the maximum stream density of the air stream has been reached. In order to be able to continue to maintain the desired and specified temperature gradient, starting from this time, water mist is mixed into the air stream, wherein the quantity of water mist is subsequently regulated in order to control the cooling process and in particular to specify the temperature gradient.

A method variant in which the air stream or the air stream with the added water mist is introduced as required into a line system for steam is further preferred. An advantage is associated therewith in particular when steam is used as the working medium for the turbine and a corresponding line system for the steam is present in any case, said line system allowing the working medium to pass through the turbine. In this case, depending on the operating mode, this very line system can be used either to conduct the working medium or to conduct the cooling medium, that is to say the air or the air with the added water mist.

It is furthermore advantageous for the air stream or the air stream with the added water mist to be introduced into the line system at a plurality of positions, in particular upstream of every pressure stage of the steam turbine. In this way, particularly uniform forced cooling of all of the turbine components can be achieved, regardless of the position thereof within the turbine.

A method variant in which the mist cooling phase is preceded in the cooling process by a heat compensation phase in which temperature equalization of the turbine components with one another takes place, primarily by heat conduction, is furthermore expedient. As a result, local temperature differences within the turbine are reduced, with the result that the risk of damage to the turbine is further reduced.

In particular in the case of the steam turbine, a variant of the method in which, at the start of the cooling process, provision is made of a steam cooling phase during which the working medium, that is to say for example the steam, is used to cool the turbine components, is additionally preferred. In this case, the temperature of the working medium is gradually lowered, wherein typically the turbine continues to be in operation, that is to say in particular generates electrical power, during this cooling phase.

In an advantageous development, during the steam cooling phase, a constant temperature gradient over time is specified for the cooling process, said temperature gradient differing from, in particular being greater than, the temperature gradient during the air cooling phase and during the mist cooling phase.

In addition, it is advantageous for very finely atomized demineralized water to be used as water mist. This avoids minerals being deposited on the turbine components from the water mist when the water droplets evaporate.

Finally, a method variant in which demineralized water is used both to produce the water mist and also as working medium is expedient. Since demineralized water has to be produced with a certain degree of technical effort, the use of demineralized water is advantageous especially when corresponding demineralized water is provided anyway as working medium for the turbine and is accordingly available anyway.

BRIEF DESCRIPTION OF THE DRAWINGS

Exemplary embodiments of the invention are explained in more detail in the following text with reference to a schematic drawing, in which.

Mutually corresponding parts are each provided with the same reference signs in all the figures.

DETAILED DESCRIPTION OF INVENTION

Figure 1:
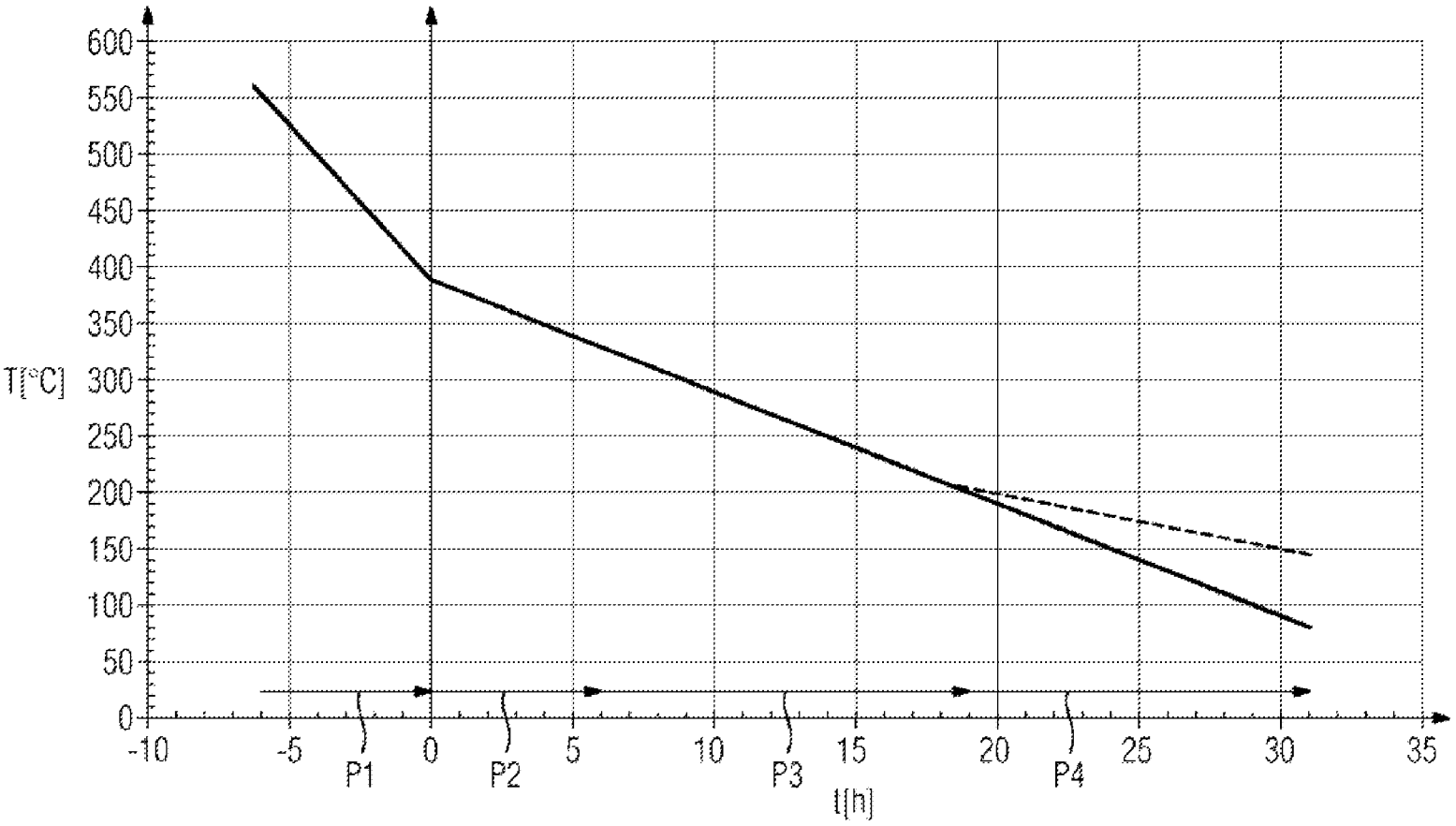
FIG. 1 shows a diagram of the variation over time of a local temperature in a steam turbine.

The method described in the following text serves to control a forced cooling process for turbine components of a steam turbine 2, wherein the control is carried out such that, as illustrated in FIG. 1, a constant temperature gradient over time is specified for the cooling process over an extended temperature range. The temperature gradient is specified here with the aid of a cooling control unit 4 which evaluates sensor data from temperature sensors 6 arranged in the steam turbine 2 and controls a cooling system on the basis thereof.

The cooling process is subdivided into four successive phases P1 . . . P4 in the exemplary embodiment. In the first phase P1 of the cooling process, the temperature of the working medium, in this case steam, is reduced, with the result that the turbine components of the steam turbine 2 are cooled down with a temperature gradient of about 30 K/h. During the steam cooling phase P1, the steam turbine 2 continues to generate electrical energy, although the electrical energy generated per unit time drops continuously.

At a temperature of the turbine components of about 390° C., the transition takes place from the steam cooling phase into a heat compensation phase P2. In this phase of the cooling process, the cooling of the turbine components by convection is interrupted in order that temperature equalization of the turbine components with one another can take place by heat conduction. As a result, relatively large temperature differences within the steam turbine 2 are intended to be removed.

After about 6 hours, the heat compensation phase P2 is ended and an air cooling phase P3 is started. During this air cooling phase P3, an air stream which is passed over the turbine components is generated. Thus, cooling of the turbine components by cooling by convection is again forced, wherein the cooling medium is no longer steam but an air stream, for the generation of which ambient air is used. In this case, the stream density of the air stream is continuously increased in order in this way to specify a temperature gradient of about 10 K/h for the cooling process of the turbine components. As the stream density of the air stream increases, the decreasing difference between the temperature of the turbine components and the temperature of the ambient air used for cooling is equalized with the result that uniform cooling is forced.

If the maximum air stream density that is achievable with the cooling apparatus has been achieved, simple cooling by an air stream no longer suffices in order to continue to maintain the desired temperature gradient for the cooling process. Depending on the temperature of the ambient air, this is typically the case at a temperature of the turbine components of about 200° C. Starting from this time point, the fourth and final phase of the cooling process starts, this being designated the mist cooling phase P4 in the following text. During this mist cooling phase P4, very finely atomized demineralized water is additionally added to the air stream, for which the maximum possible stream density continues to be maintained. As a result, the cooling by convection is supplemented by evaporative cooling, this allowing the desired temperature gradient for the cooling process to be maintained. In order to regulate the temperature gradient, the quantity of demineralized water which is added to the air stream as very finely atomized water is regulated.

Finally, at a temperature of the turbine components of between 100° C. and 150° C., the controlled cooling process ends and is typically followed by the opening of the steam turbine 2, and in particular the opening of a housing that is normally provided. Subsequently, the maintenance work at hand, on account of which the steam turbine 2 is typically shut down and cooled, can be carried out.

In addition to the solid curve, illustrated in FIG. 1, reproducing the temperature profile of the turbine components in the case of forced cooling in accordance with the method presented here, a temperature profile that deviates therefrom is additionally indicated by way of dashed lines. This deviating temperature profile of the turbine components is characteristic of a cooling process in which the cooling is forced exclusively with the aid of an air stream without the additional introduction of water mist into the air stream. With this temperature profile, the temperature range from 100° C. to 150° C., at which the maintenance work is typically started, is reached very much later. Accordingly, the downtimes of the steam turbine 2 during maintenance work are considerably shortened by the application of the method presented here, this allowing more economical use of the steam turbine 2.

Figure 2:
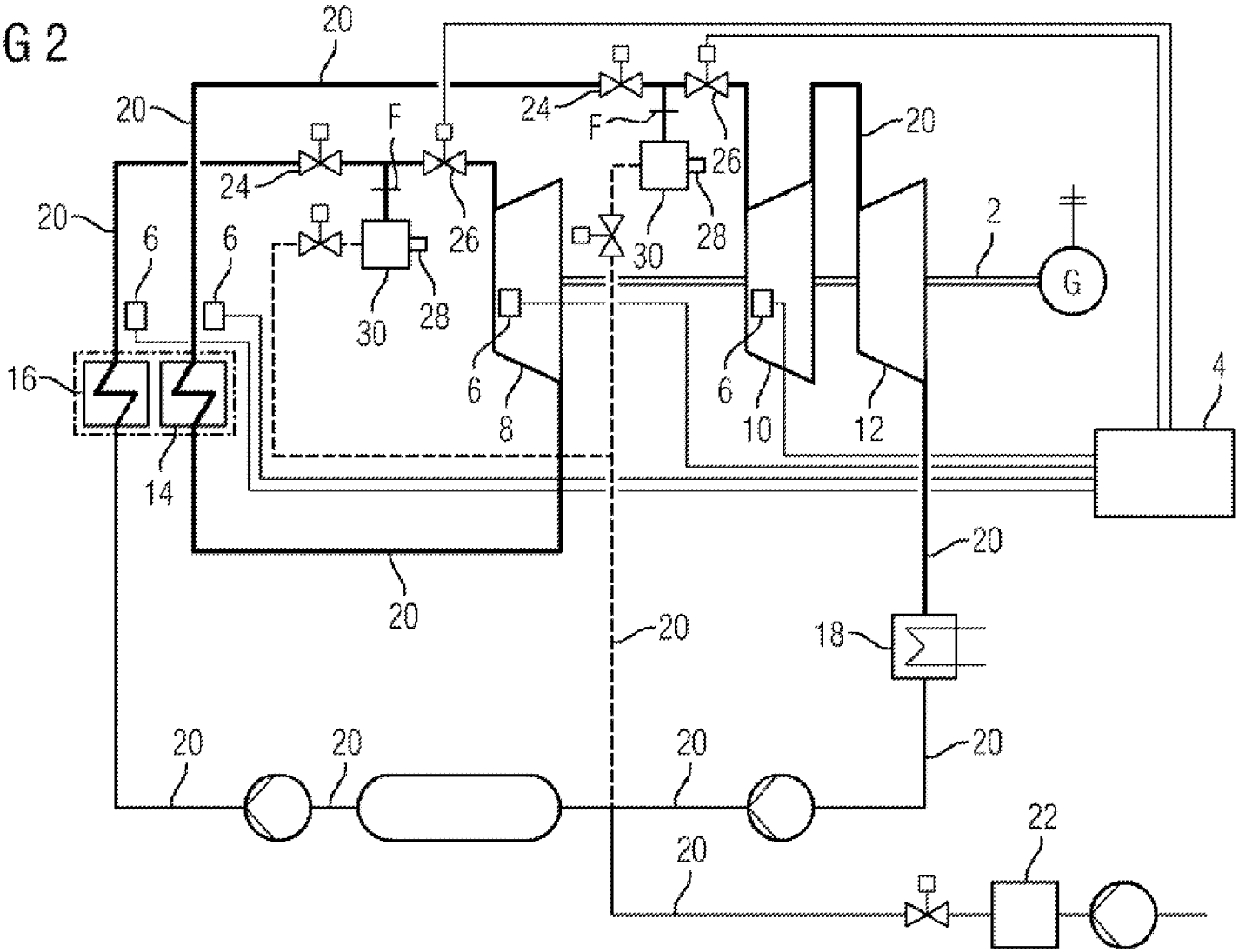
FIG. 2 shows a block diagram illustration of a steam turbine having a controllable cooling device.

A possible configuration of an installation in which the steam turbine 2 and a cooling apparatus for implementing the method presented here are used is schematically depicted in FIG. 2. By way of example, the installation comprises in this case the steam turbine 2 with a high pressure stage 8, with a medium pressure stage 10 and with a low-pressure stage 12, a superheater unit 14 connected between the high pressure stage 8 and the medium pressure stage 10, a steam generator 16, a condenser 18 and a line system 20 for the working medium, in this case demineralized water and corresponding steam.

Also part of the installation is a reservoir 22, with the aid of which a loss of demineralized water can, if necessary, be compensated.

In order, if required, to be able to force cooling in particular of the pressure stages 8 and 10 in accordance with the method presented here and in order to be able to control the cooling in the case of a correspondingly forced cooling process, the installation has the cooling control unit 4, which is preferably part of a central control unit of the installation.

If a cooling process is now initiated for example by an operator, the cooling control unit 4 first of all controls the steam generator 16 and the superheater unit 14 such that the temperature of the evaporated demineralized water which is passed through the pressure stages 8, 10, 12 gradually drops. In this way, the steam cooling phase P1 is implemented.

Two shut-off valves 24 and two regulating valves 26, one of each in a supply line of the line system 20 to the high pressure stage 8 and one of each in a supply line of the line system 20 to the medium pressure stage 10, are closed at the transition to the heat compensation phase P2 with the result that cooling by convection is prevented. Instead, temperature compensation takes place by heat conduction within the pressure stages 8, 10, 12. During this, the two supply lines are each opened towards the environment via a flange F.

At the start of the following air cooling phase P3, the regulating valves 26 are gradually opened so that ambient air can flow in each case via an opening 28 into the supply lines of the line system 20 toward the pressure stages 8, 10, 12. At the same time, a negative pressure is established in the condenser 18 by a corresponding, but not explicitly illustrated, evacuation apparatus, such that as a result ambient air flows in at the openings 28 and flows through the pressure stages 8, 10, 12. In this case, the stream density of the air stream is set by the respective pressure stage 8, 10, 12 via the valve position of the regulating valves 26.

At the start of the mist cooling phase P4, demineralized water from the reservoir 22 is additionally mixed, with the aid of spraying apparatuses 30, into the air stream used for cooling, with the result that an air stream with added very finely atomized demineralized water is passed through the pressure stages 8, 10, 12 in order to cool the latter. Subsequently, the stream density of the air stream is kept constant and only the quantity of demineralized water which is added to the air stream varies until the pressure stages 8, 10, 12 have been cooled down to the desired temperature.

The invention is not limited to the above-described exemplary embodiment. Rather, other variants of the invention can be derived therefrom by a person skilled in the art without departing from the subject matter of the invention. In particular, all of the individual features described in conjunction with the exemplary embodiment are furthermore also combinable with one another in other ways without departing from the subject matter of the invention.

The invention claimed is:

1. A method for controlling a cooling process of turbine components, comprising:

during a mist cooling phase (P4), using an air stream with added water mist to cool the turbine components, wherein the mist cooling phase (P4) is preceded by an air cooling phase (P3) during which an air stream is used to cool the turbine components, wherein, during the air cooling phase (P3) and during the mist cooling phase (P4), a constant temperature gradient over time is specified for the cooling process, wherein a temperature gradient over time of about 10 K/h is specified, wherein, in order to specify the temperature gradient, the air stream density is regulated during the air cooling phase (P3) and the quantity of water mist added to the air stream is regulated during the mist cooling phase (P4), wherein the air stream density is set via the valve position of a controllable regulating valve, wherein a switch is made from the air cooling phase (P3) into the mist cooling phase (P4) when the maximum air stream density has been reached, wherein the mist cooling phase (P4) is preceded in the cooling process by a heat compensation phase (P2) in which temperature equalization of the turbine components with one another takes place, wherein, at the start of the cooling process, provision is made of a steam cooling phase (P1) during which steam is used to cool the turbine components, wherein, during the steam cooling phase (P1), a constant temperature gradient over time is specified for the cooling process, said temperature gradient differing from the temperature gradient during the air cooling phase (P3) and during the mist cooling phase (P4).

2. The method as claimed in claim 1, wherein the air stream or the air stream with the added water mist is introduced as required into a line system for steam.

3. The method as claimed in claim 2, wherein the air stream or the air stream with the added water mist is introduced into the line system at a plurality of positions.

4. The method as claimed in claim 1, wherein atomized demineralized water is used as water mist.

5. The method as claimed in claim 4, wherein demineralized water is used both to produce the water mist and also as a working medium.

6. The method of claim 1, wherein the turbine components comprise a steam turbine shaft.

7. The method of claim 1, wherein the switch is made from the air cooling phase (P3) into the mist cooling phase (P4) when the maximum air stream density has been reached when the regulating valve is fully open.

8. The method of claim 1, wherein, during the steam cooling phase (P1), the temperature gradient is greater than the temperature gradient during the air cooling phase (P3) and during the mist cooling phase (P4).

9. The method of claim 3, wherein the air stream or the air stream with the added water mist is introduced into the line system upstream of every pressure stage of a steam turbine.

* * * * *